US011732212B2

(12) United States Patent
Hudson

(10) Patent No.: US 11,732,212 B2
(45) Date of Patent: Aug. 22, 2023

(54) AQUEOUS METALWORKING FLUIDS AND METHODS FOR USING THE SAME

(71) Applicant: CASTROL LIMITED, Reading (GB)

(72) Inventor: Robert Paul Hudson, Reading (GB)

(73) Assignee: Castrol Limited, Reading (GB)

( * ) Notice: Subject to any disclaimer, the term of this patent is extended or adjusted under 35 U.S.C. 154(b) by 0 days.

(21) Appl. No.: 17/311,656

(22) PCT Filed: Dec. 4, 2019

(86) PCT No.: PCT/EP2019/083755
§ 371 (c)(1),
(2) Date: Jun. 7, 2021

(87) PCT Pub. No.: WO2020/115177
PCT Pub. Date: Jun. 11, 2020

(65) Prior Publication Data

US 2022/0119731 A1 Apr. 21, 2022

(30) Foreign Application Priority Data

Dec. 5, 2018 (GB) ..... 1819834

(51) Int. Cl.
*C10M 173/02* (2006.01)
*B21D 37/18* (2006.01)
(Continued)

(52) U.S. Cl.
CPC ..... *C10M 173/02* (2013.01); *B21D 37/18* (2013.01); *C10M 2201/02* (2013.01);
(Continued)

(58) Field of Classification Search
CPC ..... C10M 173/02; C10M 2201/02; C10M 2209/107; B21D 37/18; C10N 2020/011;
(Continued)

(56) References Cited

U.S. PATENT DOCUMENTS 3,980,571 A 9/1976 Marx
4,146,488 A * 3/1979 Martin ..... C10M 173/02 508/472
(Continued)

FOREIGN PATENT DOCUMENTS

CN 101805658 A 8/2010
EP 0053797 A1 6/1982
(Continued)

OTHER PUBLICATIONS

Anonymous, "BREOX 75W 18000", Sep. 18, 2006 (Sep. 18, 2006), p. 1-2, URL: http://www.ilco-chemie.de/downloads/BREOX_75W_18000_E.pdf [retrieved on Feb. 26, 2020].
(Continued)

*Primary Examiner* — Ellen M McAvoy
(74) *Attorney, Agent, or Firm* — McDonnell Boehnen Hulbert & Berghoff LLP

(57) ABSTRACT

This disclosure relates generally to metalworking fluids. This disclosure relates more particularly to water-soluble metalworking fluids that include high viscosity polymers, and that can be used in metal cold rolling operations.

20 Claims, 1 Drawing Sheet

(51) Int. Cl.

| | |
|---|---|
| *C10N 40/20* | (2006.01) |
| *C10N 20/00* | (2006.01) |
| *C10N 20/02* | (2006.01) |
| *C10N 30/02* | (2006.01) |
| *C10N 30/06* | (2006.01) |
| *C10N 30/12* | (2006.01) |
| *C10N 30/16* | (2006.01) |
| *C10N 40/24* | (2006.01) |

(52) U.S. Cl.
CPC . *C10M 2209/107* (2013.01); *C10N 2020/011* (2020.05); *C10N 2020/02* (2013.01); *C10N 2030/02* (2013.01); *C10N 2030/06* (2013.01); *C10N 2030/12* (2013.01); *C10N 2030/16* (2013.01); *C10N 2040/24* (2013.01); *C10N 2040/243* (2020.05)

(58) Field of Classification Search
CPC ..... C10N 2020/02; C10N 2030/02; C10N 2030/06; C10N 2030/12; C10N 2030/16; C10N 2040/24; C10N 2040/243
USPC ..... 72/42
See application file for complete search history.

(56) References Cited

U.S. PATENT DOCUMENTS

| | | | | |
|---|---|---|---|---|
| 4,151,099 | A | 4/1979 | Maxwell | |
| 4,452,711 | A * | 6/1984 | Laemmle | C10M 145/38 508/495 |
| 4,452,712 | A * | 6/1984 | Laemmle | C10M 173/02 508/495 |
| 4,526,697 | A * | 7/1985 | Cox | C10M 135/10 252/75 |
| 4,670,168 | A * | 6/1987 | Laemmle | C10M 145/28 508/512 |
| 5,580,845 | A * | 12/1996 | Ruane | C10M 129/10 508/579 |
| 5,706,684 | A * | 1/1998 | Gong | C10M 145/34 508/322 |
| 5,849,368 | A | 12/1998 | Hostettler | |
| 6,316,394 | B1 * | 11/2001 | Morgan | C10M 173/02 508/440 |
| 6,592,775 | B1 * | 7/2003 | Skold | C10M 173/02 252/79 |
| 7,018,959 | B2 * | 3/2006 | McCullough | C10M 173/02 508/579 |
| 8,703,684 | B2 | 4/2014 | Kakuchi et al. | |
| 2004/0082728 | A1 | 4/2004 | Wu et al. | |
| 2005/0020457 | A1 * | 1/2005 | Rohrbach | C10M 173/02 508/501 |
| 2009/0170736 | A1 * | 7/2009 | Brutto | C10M 173/02 554/108 |
| 2011/0162425 | A1 * | 7/2011 | Hof | C09K 23/00 508/579 |
| 2014/0128299 | A1 * | 5/2014 | Zhao | C10M 133/44 508/280 |
| 2014/0142013 | A1 | 5/2014 | Elomari | |

FOREIGN PATENT DOCUMENTS

| | | | |
|---|---|---|---|
| EP | 0369692 | A1 | 5/1990 |
| WO | 2013070913 | A1 | 5/2013 |

OTHER PUBLICATIONS

Anonymous, "UCON Lubricant 75-H Series Base Stocks", Oct. 1, 2018 (Oct. 1, 2018), p. 1-4 URL: http://www.dow.com/content/dam/dcc/documents/en-us/productdatasheet/816/816-00049-01-ucon-lubricant-75-h-series-base-stocks.pdf [retrieved on Nov. 14, 2018].

International Search Report and Written Opinion of the International Searching Authority for International Application No. PCT/EP2019/083755, completed Feb. 27, 2020.

* cited by examiner

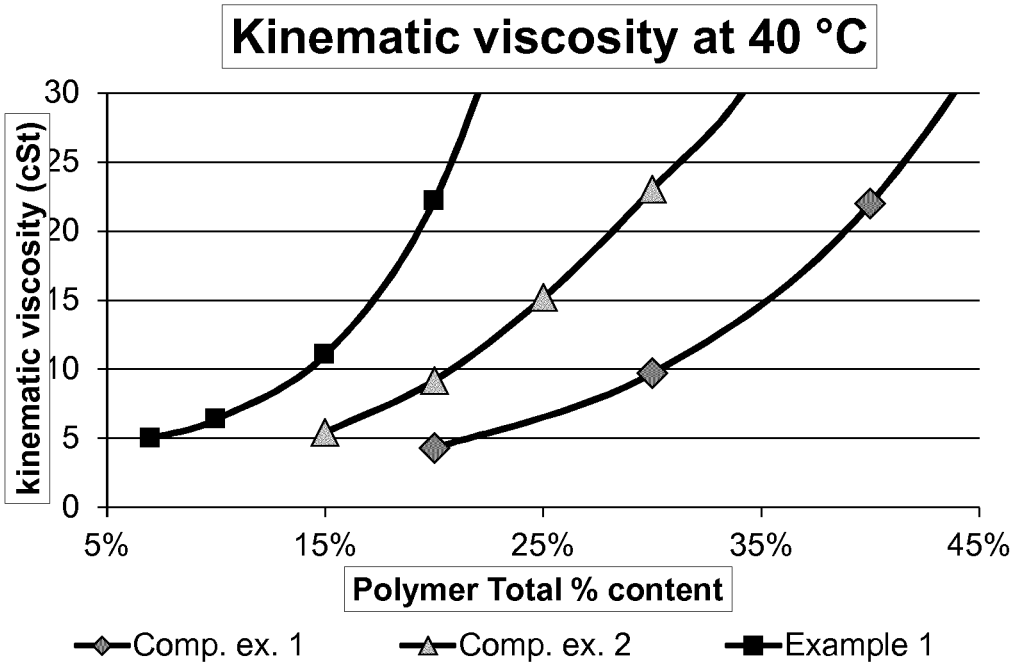
Kinematic viscosity at 40 °C
kinematic viscosity (cSt)
30
25
20
15
10
5
0
5%
15%
25%
35%
45%
Polymer Total % content
Comp. ex. 1
Comp. ex. 2
Example 1

AQUEOUS METALWORKING FLUIDS AND METHODS FOR USING THE SAME

This application is a national stage application under 35 U.S.C. § 371 of International Application No. PCT/EP2019/083755, filed Dec. 4, 2019, which claims priority to Great Britain Application No. 1819834.1, filed Dec. 5, 2018, the disclosures of which are explicitly incorporated by reference herein.

BACKGROUND OF THE DISCLOSURE

Field of the Disclosure

This disclosure relates generally to metalworking fluids. This disclosure relates more particularly to metalworking fluids that include high viscosity polymers, and that can be used in metal cold rolling operations.

Technical Background

While metalworking fluids find many applications within the metalworking industry, they are typically used in destructive metalworking (i.e., applications in which material is substantially removed from the workpiece, such as in the form of chips or other particles, such as milling or grinding) and in deformation metalworking (i.e., applications in which material is not substantially removed from the workpiece, such as rolling). In order to provide lubrication and heat control, a metalworking fluid is often used in a metalworking process, for example, at a surface between a tool and a workpiece.

Use of metalworking fluid is particularly important in cold rolling operations, such as cold rolling of steel. The metalworking fluid is used, for example, to decrease roll force and/or decrease roll wear. Traditionally, metalworking fluids for cold rolling were based on neat oils or on oil-in-water emulsions. Both have their drawbacks. For example, an oil-in-water emulsion traditionally relies on concentration and saponification value, assessing the dilution of the saponifiable content by tramp oil ingress (rogue contamination). To avoid emulsion fluctuations, the oil-in-water emulsions typically need to be controlled for control emulsion stability and particle size, mostly relying on surfactant technology to impart the desired properties. These systems are prone to change over time either becoming over tight and not releasing enough oil, or conversely becoming unstable and generating dirty mills and slippage. Neat oils, on the other hand, may have insufficient cooling and unacceptable flammability.

It would be advantageous, however, to produce metalworking fluids suitable for use in cold rolling operations that overcome the shortcomings associated with emulsions or neat oils.

SUMMARY OF THE DISCLOSURE

The present inventors have noted the deficiencies in the art. For example, the present inventors have noted that in certain cases desirable metalworking fluids would be able to decrease roll force and/or decrease roll wear. In addition, desirable metalworking fluid compositions in many cases would exhibit one or more of the following properties: extreme pressure lubricating ability, anti-wear lubricating properties, anticorrosion properties, and/or cooling properties. In many metalworking operations, it is desirable that metalworking fluid compositions do not have a tendency to form deposits on the surface of the metal or to form sticky residue on the apparatus employed in metalworking (sometimes called 'caking'). And it is often desirable that metalworking fluid compositions for use in metalworking operations such as cold rolling do not have a tendency to exhibit wide variations in the coefficient of friction during use.

The present inventors have identified water-based metalworking fluid compositions that can be used in metal cold rolling operations. In certain aspects, the compositions of the disclosure can, for example, provide improved lubrication performance (e.g., in some embodiments even as good as conventional rolling oil) without need for emulsification. Therefore, the compositions of the disclosure can in many embodiments avoid drawbacks of the traditional oil-in-water emulsion products, such as the need for control of emulsion consistency and use of surfactants. Rather, the desired consistency of metalworking fluid compositions of the disclosure can in many cases be imparted by controlling the viscosity of both the final composition and the underlying water-soluble polymer(s). In fact, the inventors identified a synergy between the viscosity of the final composition and the viscosity of the underlying water-soluble polymer(s). As a result, the metalworking fluid compositions according to certain aspects of the disclosure can maintain a consistent performance over a long period of time due to the relatively invariant nature of composition and its underlying ingredients. The metalworking fluid compositions of the disclosure can also, in certain embodiments, have improved thermal management and heat release capabilities, and can be provided simply and cost-efficiently.

Thus, one aspect of the disclosure provides an aqueous metalworking fluid composition including:

one or more water-soluble polymers, each having a kinematic viscosity at 40° C. of at least 5000 cSt and no cloud point within a temperature range of 20° C. to 80° C., present in a total amount in the range of 0.5 wt % to 15 wt %; and water, present in an amount of at least 70 wt %, wherein the composition has a kinematic viscosity at 40° C. in the range of 1 cSt to 20 cSt, and wherein the one or more water-soluble polymers are dissolved in an aqueous phase of the aqueous metalworking fluid.

Throughout this specification the term "water-soluble" means essentially completely soluble in water, either inherently or when reacted in situ to make a salt thereof. It is understood that a material can be "water-soluble" yet leave a minor residue undissolved, but this will be a very small amount, i.e., less than 0.5% by weight of the "water-soluble" material. Similarly, a material that is "dissolved" in an aqueous phase can have a minor undissolved residue, i.e., less than 0.5% by weight of the material.

In certain embodiments, the aqueous metal working fluid further includes one or more of corrosion inhibitors, rust inhibitors, lubricity enhancers, friction modifiers, chelating agents, coupling agents, yellow metal inhibitors, esters, biocides, and combinations thereof (e.g., present in a total amount up to 15 wt %). In certain embodiments, the aqueous metal working fluid further includes six or more, eight or more, or nine or more, or even ten or more of corrosion inhibitors, rust inhibitors, lubricity enhancers, friction modifiers, chelating agents, coupling agents, yellow metal inhibitors, esters, biocides, and combinations thereof (e.g., present in a total amount up to 15 wt %). In certain embodiments, the aqueous metal working fluid further includes one or more of corrosion inhibitors, chelating agents, yellow metal inhibitors, optionally biocides, and combinations thereof (e.g., present in a total amount up to 15 wt %).

In certain embodiments, the metalworking fluid composition of the disclosure includes:

the water-soluble polymer;

a corrosion-inhibiting combination comprising one or more carboxylic acids in an amount in the range of 0.1 wt % to 1 wt % and one or more amines in an amount in the range of 0.1 wt % to 2 wt %;

one or more yellow metal inhibitors (e.g., a triazole) in an amount in the range of 0.01 wt % to 0.2 wt %;

optionally, one or more pressure-protective additives (e.g., phosphate ester) in an amount of up to 0.25 wt %; and optionally, a biocide in an amount in the range of 0.05 wt % to 0.25 wt %.

In certain embodiments, the metalworking fluid compositions of the disclosure are substantially free or free of mineral oil and silicone oil.

Another aspect of the disclosure provides a metalworking fluid concentrate. In certain embodiments, the concentrate is provided at a concentration such that it can be diluted with aqueous media to provide the metalworking fluid composition of the disclosure. The concentrate can also be provided as a top-treat additive that can be, for example, added to an existing but depleted metalworking fluid in order to bring it back to a desirable composition. One such metalworking fluid concentrate of the disclosure includes:

one or more water-soluble polymers, each having a kinematic viscosity at 40° C. of at least 5000 cSt and no cloud point within a temperature range of 20° C. to 80° C., present in a total amount in the range of 25 wt % to 70 wt %;

optionally, one or more of pressure-protective additives, corrosion inhibitors, rust inhibitors, lubricity enhancers, friction modifiers, chelating agents, coupling agents, yellow metals, biocides, and combinations thereof are present in the composition in an amount in the range up to 40 wt %; and water, present in an amount of at least 8 wt %, wherein the one or more water-soluble polymers, optional additives when present, and the water are dissolved in one another to form a single aqueous phase.

Another aspect of the disclosure provides methods of cold working (e.g., cold rolling) a metal. In some embodiments, such methods include:

contacting a surface of one or more working tools (e.g., rolls) with a metalworking fluid composition of the disclosure; and forming a surface of a metal article to a desired shape with the one or more working tools in contact with the metalworking fluid composition.

In some embodiments, such methods include:

obtaining a first portion of a metalworking fluid composition of the disclosure;

contacting a surface of one or more working tools with the first portion of the metalworking fluid composition to generate a spent first portion;

treating the spent first portion with a metalworking fluid concentrate of the disclosure (i.e., as a top-treat additive) to generate a treated first portion;

contacting the surface of one or more working tools with the treated second portion; and forming a surface of a metal article to a desired shape in contact with the treated first portion.

In some embodiments, such methods include:

dissolving an amount of a top-treat additive of the disclosure in an aqueous fluid (e.g., water) to obtain a metalworking fluid composition of the disclosure, wherein the amount of the top-treat additive is sufficient to provide the metalworking fluid composition having a kinematic viscosity at 40° C. in the range of 1 cSt and 20 cSt;

contacting a surface of one or more working tools with the metalworking fluid composition; and forming a surface of a metal article to a desired shape with the working tools in contact with the metal working fluid composition.

BRIEF DESCRIPTION OF THE DRAWINGS

The accompanying drawings are included to provide a further understanding of the compositions and methods of the disclosure, and are incorporated in and constitute a part of this specification. The drawings are not necessarily to scale, and sizes of various elements may be distorted for clarity. The drawings illustrate one or more embodiment(s) of the disclosure, and together with the description serve to explain the principles and operation of the disclosure.

FIG. 1 is graph illustrating the relationship between the amount of the water-soluble polymer in the composition and the kinematic viscosity at 40° C. of the composition.

DETAILED DESCRIPTION

The particulars shown herein are by way of example and for purposes of illustrative discussion of the preferred embodiments of the present invention only and are presented in the cause of providing what is believed to be the most useful and readily understood description of the principles and conceptual aspects of various embodiments of the invention. In this regard, no attempt is made to show structural details of the invention in more detail than is necessary for the fundamental understanding of the invention, the description taken with the drawings and/or examples making apparent to those skilled in the art how the several forms of the invention may be embodied in practice. Thus, before the disclosed processes and devices are described, it is to be understood that the aspects described herein are not limited to specific embodiments, apparatuses, or configurations, and as such can, of course, vary. It is also to be understood that the terminology used herein is for the purpose of describing particular aspects only and, unless specifically defined herein, is not intended to be limiting.

The terms "a," "an," "the" and similar referents used in the context of describing the invention (especially in the context of the following embodiments and claims) are to be construed to cover both the singular and the plural, unless otherwise indicated herein or clearly contradicted by context. Recitation of ranges of values herein is merely intended to serve as a shorthand method of referring individually to each separate value falling within the range. Unless otherwise indicated herein, each individual value is incorporated into the specification as if it were individually recited herein. Ranges can be expressed herein as from "about" one particular value, and/or to "about" another particular value. When such a range is expressed, another aspect includes from the one particular value and/or to the other particular value. Similarly, when values are expressed as approximations, by use of the antecedent "about," it will be understood that the particular value forms another aspect. It will be further understood that the endpoints of each of the ranges are significant both in relation to the other endpoint, and independently of the other endpoint.

All methods described herein can be performed in any suitable order of steps unless otherwise indicated herein or otherwise clearly contradicted by context. The use of any and all examples, or exemplary language (e.g., "such as") provided herein is intended merely to better illuminate the invention and does not pose a limitation on the scope of the invention otherwise claimed. No language in the specification should be construed as indicating any non-claimed element essential to the practice of the invention.

Unless the context clearly requires otherwise, throughout the description and the claims, the words 'comprise', 'comprising', and the like are to be construed in an inclusive sense as opposed to an exclusive or exhaustive sense; that is to say, in the sense of "including, but not limited to". Words using the singular or plural number also include the plural and singular number, respectively. Additionally, the words "herein," "above," and "below" and words of similar import, when used in this application, shall refer to this application as a whole and not to any particular portions of the application.

As will be understood by one of ordinary skill in the art, each embodiment disclosed herein can comprise, consist essentially of or consist of its particular stated element, step, ingredient or component. As used herein, the transition term "comprise" or "comprises" means includes, but is not limited to, and allows for the inclusion of unspecified elements, steps, ingredients, or components, even in major amounts. The transitional phrase "consisting of" excludes any element, step, ingredient or component not specified. The transition phrase "consisting essentially of" limits the scope of the embodiment to the specified elements, steps, ingredients or components and to those that do not materially affect the embodiment.

All percentages, ratios and proportions herein are by weight, unless otherwise specified.

Notwithstanding that the numerical ranges and parameters setting forth the broad scope of the invention are approximations, the numerical values set forth in the specific examples are reported as precisely as possible. Any numerical value, however, inherently contains certain errors necessarily resulting from the standard deviation found in their respective testing measurements.

Groupings of alternative elements or embodiments of the invention disclosed herein are not to be construed as limitations. Each group member may be referred to and claimed individually or in any combination with other members of the group or other elements found herein. It is anticipated that one or more members of a group may be included in, or deleted from, a group for reasons of convenience and/or patentability. When any such inclusion or deletion occurs, the specification is deemed to contain the group as modified thus fulfilling the written description of all Markush groups used in the appended claims.

Some embodiments of this invention are described herein, including the best mode known to the inventors for carrying out the invention. Of course, variations on these described embodiments will become apparent to those of ordinary skill in the art upon reading the foregoing description. The inventor expects skilled artisans to employ such variations as appropriate, and the inventors intend for the invention to be practiced otherwise than specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

Furthermore, numerous references have been made to patents and printed publications throughout this specification. Each of the cited references and printed publications are individually incorporated herein by reference in their entirety.

In closing, it is to be understood that the embodiments of the invention disclosed herein are illustrative of the principles of the present invention. Other modifications that may be employed are within the scope of the invention. Thus, by way of example, but not of limitation, alternative configurations of the present invention may be utilized in accordance with the teachings herein. Accordingly, the present invention is not limited to that precisely as shown and described.

In general, the various aspects and embodiments of the disclosure provide improvements in metalworking fluid compositions that can, in various embodiments, be cost-efficient and sustainable, and provide good lubrication properties. Specifically, the inventors have found that, in certain embodiments, single-phase water-soluble metalworking fluid compositions of the disclosure perform as well as rolling oil over a long period of time.

Thus, one aspect of the disclosure provides an aqueous metalworking fluid composition including one or more water-soluble polymers, each having a kinematic viscosity at 40° C. of at least 5000 cSt and no cloud point within a temperature range of 20° C. to 80° C., present in a total amount in the range of 0.5 wt % to 15 wt %; and water, present in an amount of at least 70 wt %, wherein the composition has a kinematic viscosity at 40° C. in the range of 1 cSt to 20 cSt, and wherein the one or more water-soluble polymers are dissolved in an aqueous phase of the aqueous metalworking fluid.

In certain embodiments, the compositions of the disclosure are substantially single-phase compositions (e.g., comprising at least 98% by weight of the aqueous phase, at least 99% by weight of the aqueous phase, at least 99.5% by weight of the aqueous phase, or at least 99.8% by weight of the aqueous phase). The metalworking fluid compositions of the disclosure are desirably free or substantially free from particles or oil droplets.

The desired performance of the metalworking fluid compositions of the disclosure can be imparted by controlling the viscosity of both the final composition (i.e., kinematic viscosities in the range of 1-20 cSt at 40° C., or as otherwise described herein) and of the underlying water-soluble polymer(s) (i.e., kinematic viscosities of at least 5000 cSt at 40° C. or as otherwise described herein); the present inventors have determined that both the viscosity of the final composition and the viscosity of the underlying water-soluble polymer(s) are important for good performance. The metalworking fluid compositions of various embodiments of the disclosure can maintain a consistent performance over a long period of time due to unchanging nature of composition and its underlying ingredients, and can also have improved thermal management and heat release capabilities.

Thus, in one aspect of the disclosure, the metalworking fluid compositions of the disclosure have a kinematic viscosity at 40° C. in the range of 1 cSt to 20 cSt. As used herein, kinematic viscosities are measured in accordance with ASTM D4603-18. In certain such embodiments, the metalworking fluid compositions of the disclosure have a kinematic viscosity at 40° C. in the range of 2 cSt to 20 cSt, or 5 cSt to 20 cSt, or 10 cSt to 20 cSt, or 1 cSt to 15 cSt, or 2 cSt to 15 cSt, or 5 cSt to 15 cSt, or 10 cSt to 15 cSt, or 1 cSt to 10 cSt, or 2 cSt to 10 cSt, or 5 cSt to 10 cSt, or 10 cSt to 15 cSt, or 10 cSt to 20 cSt, or 5 cSt to 15 cSt, or 3 cSt to 7 cSt, or 4 cSt to 6 cSt, or 4.5 cSt to 5.5 cSt. In certain such embodiments, the metalworking fluid compositions of the disclosure have a kinematic viscosity at 40° C. of about 5 cSt.

As described above, the viscosity of the one or more water-soluble polymers is also an important parameter for performance of the fluid. Thus, in one aspect of the disclosure, the kinematic viscosity at 40° C. of each of the one or more water-soluble polymers is at least 5000 cSt, for example, in the range of 5000 cSt to 100000 cSt, or 5000 cSt to 75000 cSt, or 5000 cSt to 50000 cSt, or 5000 cSt to 30000 cSt, or 5000 cSt to 25000 cSt, or 5000 cSt to 20000 cSt. In certain such embodiments, the water-soluble polymer of the disclosure have a kinematic viscosity at 40° C. at least 7500 cSt, e.g., at least 10000 cSt, or at least 15000 cSt, or at least 17000 cSt, for example, in the range of 7500 cSt to 100000 cSt, or 7500 cSt to 75000 cSt, or 7500 cSt to 50000 cSt, or 7500 cSt to 30000 cSt, or 10000 cSt to 100000 cSt, or 10000 cSt to 75000 cSt, or 10000 cSt to 50000 cSt, or 10000 cSt to 30000 cSt, or 10000 cSt to 25000 cSt, or 10000 cSt to 20000 cSt, or 10000 cSt to 19000 cSt, or 10000 cSt to 18000 cSt, or 15000 cSt to 100000 cSt, or 15000 cSt to 75000 cSt, or 15000 cSt to 50000 cSt, or 15000 cSt to 30000 cSt, or 15000 cSt to 25000 cSt, or 15000 cSt to 20000 cSt, or 15000 cSt to 19000 cSt, or 17000 cSt to 100000 cSt, or 17000 cSt to 75000 cSt, or 17000 cSt to 50000 cSt, or 17000 cSt to 30000 cSt, or 17000 cSt to 25000 cSt or 17000 cSt to 20000 cSt, or 17000 cSt to 19000 cSt.

The water-soluble polymer of the disclosure may have high or very high viscosity index (VI) as measured in accordance with ASTM D 2270, depending on the end application of the metalworking composition of the disclosure. VI is a measure for the change of viscosity of the polymer with variations in temperature. The lower the VI, the greater the change of viscosity of the polymer with temperature. In certain embodiments of the compositions as otherwise described herein, the one or more water-soluble polymers has viscosity index at least 80. In certain embodiments of the compositions as otherwise described herein, the one or more water-soluble polymers has viscosity index of at least 120, or at least 200, or even at least 300. In various embodiments, the viscosity index is in the range of 80-800, or 80-650, or 80-500, or 120-800, or 120-650, or 200-800, or 200-650, or 200-500, or 300-800, or 300-650, or 300-500. Similarly, in certain embodiments as otherwise described herein, each of the one or more water soluble polymers has a kinematic viscosity at 100° C. of no more than 20000 cSt, e.g., no more than 15000 cSt or no more than 10000 cSt. In certain such embodiments, each of the one or more water soluble polymers has a kinematic viscosity at 100° C. in the range of 500-20000 cSt, or 500-15000 cSt, or 500-10000 cSt, or 500-5000 cSt, or 1000-20000 cSt, or 1000-15000 cSt, or 1000-10000 cSt, or 1000-5000 cSt, of 2000-5000 cSt.

Notably, each of the one or more water-soluble polymers exhibits little phase separation over typical usage temperatures of the composition. Thus, each of the one or more water-soluble polymers of the metalworking compositions of the disclosure has no cloud point within a temperature range of 20° C. to 80° C. In certain embodiments as otherwise described herein, each of the one or more water-soluble polymers has no cloud point within a temperature range of 10° C. to 80° C., or 0° C. to 80° C., or 20° C. to 100° C., or 10° C. to 100° C., or 0° C. to 100° C., or 20° C. to 120° C., or 10° C. to 120° C., or 0° C. to 120° C.

A variety of water-soluble polymers can be used in the compositions of the disclosure. In certain embodiments as otherwise described herein, each of the one or more water-soluble polymers is a polyalkylene glycol polymer, for example, a polymer of one or more of ethylene oxide, propylene oxide and butylene oxide. For example, in some embodiments, the polyalkylene glycol polymer may be a copolymer of two or more of ethylene oxide, propylene oxide, and butylene oxide. In certain embodiments, the polyalkylene glycol polymer may be a copolymer of ethylene oxide and propylene oxide. In certain other embodiments, the polyalkylene glycol polymer may be a copolymer of ethylene oxide and propylene oxide in the ratio of 25:75 to 75:25 by weight. The polyalkylene glycol polymer may be, for example, diol-initiated or polyol initiated. In certain embodiments, the polyalkylene glycol polymer may be a random copolymer (e.g., of ethylene oxide and propylene oxide). In desirable copolymers of the disclosure, ethylene oxide, propylene oxide and/or butylene oxide subunits make up at least 95%, e.g., at least 98% or even at least 99% of the mass of the copolymer.

As noted above, the one or more water soluble polymers is present in the metalworking compositions of the disclosure in an amount in the range of 0.5 wt % to 15 wt %. Based on the disclosure herein, the person of ordinary skill in the art will select types, amounts and viscosities of water-soluble polymer(s) to provide the desired viscosity and metalworking performance to the metalworking composition. In certain embodiments as otherwise described herein, the one or more water soluble polymers is present in a total amount of 0.5 wt % to 10 wt %, or 0.5 wt % to 5 wt %, or 0.5 to 4 wt %, or 0.5 wt % to 3 wt %, or 0.5 wt % to 2 wt %, or 0.5 wt % to 1.5 wt %, or 1 wt % to 15 wt %, or 1 wt % to 10 wt %, or 1 wt % to 5 wt %, or 1 to 4 wt %, or 1 wt % to 3 wt %, based on the total weight of the composition.

The person of ordinary skill in the art will appreciate that the individual polymer molecules of a given water soluble polymer will often have a variety of molecular weights and structures in a given sample. Unless otherwise indicated, a "molecular weight" as used throughout is "weight-average" molecular weight, $M_w$, as determined by gel permeation chromatography. The structures provided herein represent a weight average structure over the sample of the polymers. The person of ordinary skill in the art will be able to distinguish between different polymers, as having substantially different average molecular weights, or substantially different structures. As the person of ordinary skill in the art will appreciate, molecular weight can impact viscosity and viscosity index. In certain embodiments as otherwise described herein, each of the one or more water soluble polymers has a $M_w$ in the range of 800 Da to 100 kDa, e.g., in the range of 2-100 kDa, or 5-100 kDa, or 10-100 kDa, or 2-50 kDa, or 5-50 kDa, or 10-50 kDa.

As described herein, the metalworking fluids of the present disclosure are advantaged because they are substantially aqueous compositions; as described above, the metalworking fluid composition of one aspect of the disclosure includes water in an amount of at least 70%. In certain embodiments as otherwise described herein, the metalworking fluids of the present disclosure include at least 75%, or at least 80%, or at least 85%, or at least 90% water. In certain embodiments, water is present in the composition in an amount in the range of 75 wt % to 99.5 wt %, or 80 wt % to 99.5 wt %, or 85 wt % to 99.5 wt %, or 90 wt % to 99.5 wt %, or 95 wt % to 99.5 wt %, or 97 wt % to 99.5 wt %, or 70 wt % to 99 wt %, or 75 wt % to 99 wt %, or 80 wt % to 99 wt %, or 85 wt % to 99 wt %, or 90 wt % to 99 wt %, or 95 wt % to 99 wt %, or 97 wt % to 99 wt %, or 70 wt % to 97 wt %, or 75 wt % to 97 wt %, or 80 wt % to 97 wt %, or 85 wt % to 97 wt %, or 90 wt % to 97 wt %, or 95 wt % to 97 wt %, or 70 wt % to 95 wt %, or 75 wt % to 95 wt %, or 80 wt % to 95 wt %, or 85 wt % to 95 wt %, or 90 wt % to 95 wt %.

The person of ordinary skill in the art will appreciate that metalworking fluids can include a number of other components. Thus, in certain embodiments as otherwise described herein, the aqueous metalworking fluid further includes one or more of pressure-protective additives, corrosion inhibitors, rust inhibitors, lubricity enhancers, friction modifiers, chelating agents, coupling agents, yellow metal inhibitors (e.g., triazole), esters, biocides and combinations thereof (e.g., present in a total amount up to 15 wt %, for example, up to 10 wt %, up to 8 wt % or up to 5 wt %, or in the range of 0.1-15 wt %, or 0.1-10 wt %, or 0.1-8 wt %, or 0.1-5 wt %, or 0.5-15 wt %, or 0.5-10 wt %, or 0.5-8 wt %, or 0.5-5 wt %, or 1-15 wt %, or 1-10 wt %, or 1-8 wt %, or 1-5 wt %, or 2-15 wt %, or 2-10 wt %, or 2-8 wt %, or 2-5 wt %, or 5-15 wt % or 5-10 wt %). In certain embodiments as otherwise described herein, the aqueous metalworking fluid further includes one or more of corrosion inhibitors, chelating agents, yellow metal inhibitors (e.g., triazole), and biocides (e.g., present in a total amount up to 15 wt %, for example, up to 10 wt %, up to 8 wt % or up to 5 wt %, or in the range of 0.1-15 wt %, or 0.1-10 wt %, or 0.1-8 wt %, or 0.1-5 wt %, or 0.5-15 wt %, or 0.5-10 wt %, or 0.5-8 wt %, or 0.5-5 wt %, or 1-15 wt %, or 1-10 wt %, or 1-8 wt %, or 1-5 wt %, or 2-15 wt %, or 2-10 wt %, or 2-8 wt %, or 2-5 wt %, or 5-15 wt % or 5-10 wt %).

In certain embodiments as otherwise described herein, the metalworking fluid composition of the disclosure may also include one or more pressure-protective additives (e.g., present in a total amount up to 5 wt %, for example, up to 2 wt %, up to 1 wt % or up to 0.5 wt % or in the range of 0.05-5 wt %, or 0.05-2 wt %, or 0.05-1 wt %, or 0.05-0.5 wt %, or 0.1-5 wt %, or 0.1-2 wt %, or 0.1-1 wt %, or 0.1-0.5 wt %, or 0.2-5 wt %, or 0.2-2 wt %, or 0.2-1 wt %, or 0.2-0.5 wt). Some suitable examples of the pressure-protective additives include, but are not limited to, a phosphate ester, amine phosphate, alkyl phosphate, aryl phosphate, carboxylic acid, and any combination thereof. In certain embodiments, the pressure-protective additive is an acidic mono-substituted phosphate ester that is neutralized with at least a stoichiometric amount of a base to form a water-soluble salt. Preferably, an excess of base is employed to neutralize the mono-substituted phosphate ester. Neutralization may take place in situ in the compositions of the present invention. The phosphate ester may be substituted with a polypropoxy or polyethoxy chain. The polypropoxy chain may have a molecular weight in the range 2 kDa to 3 kDa. The polyethoxy chain may comprise from 3 to 5 ethoxy units. Where the mono-substituted phosphate ester is substituted with a polyethoxy chain, the chain may terminate in an alkyl group. The terminating alkyl group may comprise a carbon chain of from 16 to 20 carbons. For example, the polyethoxy chain may comprise 4 ethoxy units and may terminate in a Cis alkyl group. The base with which the mono-substituted phosphate ester is neutralized may be any base capable of neutralizing the mono-substituted phosphate ester to form a water-soluble salt. The base may be a non-inorganic base, such as an amine. The amine may be one or more primary and/or tertiary alkanol amines. Suitable alkanol amines include monoethanolamine and triethanolamine.

The metalworking fluid composition of the disclosure may also include one or more of corrosion inhibitors, rust inhibitors, lubricity enhancers, friction modifiers, chelating agents, coupling agents, yellow metal inhibitors, esters, biocides, and combinations thereof (e.g., present in a total amount up to 15 wt %, for example, up to 10 wt %, up to 8 wt % or up to 5 wt % or in the range of 0.1-15 wt %, or 0.1-10 wt %, or 0.1-8 wt %, or 0.1-5 wt %, or 0.5-15 wt %, or 0.5-10 wt %, or 0.5-8 wt %, or 0.5-5 wt %, or 1-15 wt %, or 1-10 wt %, or 1-8 wt %, or 1-5 wt %, or 2-15 wt %, or 2-10 wt %, or 2-8 wt %, or 2-5 wt %, or 5-15 wt % or 5-10 wt %). Suitable chelating agents include, but are not limited to, polyacrylic acid and ethylene diamine tetra acetic acid (or salts thereof) (EDTA). Suitable yellow metal inhibitors include, but are not limited to, benzotriazole or its derivatives and tolutriazole or its derivatives. Suitable esters include, but are not limited to, trimethylol propane (TMP), mono-, di- and tri-esters of $C_8$-$C_{18}$ fatty acids, glycol esters of predominantly olelyl fatty acids, methyl or isopropyl esters of predominantly oleyl fatty acids or triglycerides, natural triglycerides (such as rapeseed), and modified natural oils (such as blown rapeseed). Suitable biocides (typically amine compounds) include, but are not limited to, formaldehyde releasing agents including ortho-formal, hexahydratriazine and derivatives, methylene bis morpholine, oxazoladine and derivatives, isothiazolinones and derivatives and iodo propyl butyl carbamate-fungicide. Suitable rust inhibitors include, but are not limited to, amine salts of carboxylic acids.

In certain embodiments, the compositions of the disclosure may further comprise one or more flocculants (such as quaternary amine), in an amount e.g., up to 1 wt %, e.g., up to 0.5 wt %.

The person of ordinary skill in the art will appreciate that a wide variety of aqueous-soluble corrosion inhibitors can be used in the compositions disclosed herein. Suitable corrosion inhibitors include, but are not limited to, water-soluble amine/alkali salts of carboxylic mono acids and/or di- and tri-acids (e.g., sebacic acid), short chain acidic phosphate esters, including alkoxylated esters, semi-succinate half esters, amide-carboxylic acid salts, fatty amides, and amine and alkali sulfonates, or their derivatives. For example, in certain embodiments, the composition includes a corrosion-inhibiting combination of one more carboxylic acids (e.g., in an amount in the range of 0.1-1 wt % and one or more amines (e.g., in an amount in the range of 0.1 wt % to 2 wt %). Desirably, substantially no free acid is in the solution; sufficient amine is used such that the acid is in the form of its amine salt.

In one exemplary embodiment, a metalworking fluid composition of the disclosure includes:

- the one or more water-soluble polymers;
- a corrosion-inhibiting combination comprising one or more carboxylic acids in an amount in the range of 0.1 wt % to 1 wt % and one or more amines in an amount in the range of 0.1 wt % to 2 wt %;
- one or more yellow metal inhibitors (e.g., triazole) in an amount in the range of 0.01 wt % to 0.2 wt %;
- optionally, one or more pressure-protective additives (e.g., phosphate ester) in an amount of up to 0.25 wt %; and
- optionally, a biocide in an amount in the range of 0.05 wt % to 0.25 wt %.

As the person of ordinary skill in the art will appreciate, the carboxylic acid and amine components can be present in aqueous solution, in part or (desirably) in whole, as ammonium carboxylates.

The person of ordinary skill in the art will appreciate that a variety of other components can be present in the metalworking fluids of the disclosure. But in certain desirable embodiments, the total amount of water and the one or more water-soluble polymers is at least 75 wt % of the total weight of the composition. In certain such embodiments, at least 80 wt %, at least 85 wt %, at least 90 wt % or even at least 95 wt % of the total weight of the composition is made up of water and the one or more water-soluble polymers.

Similarly, in certain desirable embodiments, the total amount of water, the one or more water-soluble polymers, and any pressure-protective additives, corrosion inhibitors, rust inhibitors, lubricity enhancers, friction modifiers, chelating agents, coupling agents, yellow metal inhibitors, esters and biocides is at least 75 wt % of the composition, e.g., at least 80 wt %, at least 85 wt %, at least 90 wt %, at least 95 wt %, at least 98 wt % or even at least 99 wt % of the composition.

The person of ordinary skill in the art will appreciate that a variety of other components can be present in the compositions of the disclosure.

However, the present compositions are especially advantaged in that they do not require the use of mineral oil or silicone oil. Thus, in certain desirable embodiments, metalworking fluid compositions of the disclosure are substantially free of mineral oil and silicone oil (e.g., include no more than 1 wt %, no more than 0.5 wt % or even no more than 0.1 wt %).

The disclosure also provides a metalworking fluid concentrate. As noted above, the metalworking concentrate can be provided at a concentration such that it can be diluted with aqueous media to provide a metalworking fluid composition of the disclosure. The concentrate can also be provided as a top-treat additive that can be, for example, added to an existing but depleted metalworking fluid in order to bring it back to a desirable composition. Such top-treat additives need not have all desirable components of the metalworking fluid; in certain embodiments a top-treat additive has one or more water-soluble polymers and water, but fewer than all (or even none) of the additives of the metalworking fluid to which it is to be added. In certain embodiments a top-treat additive has one or more water-soluble polymers, water, and optionally one or more corrosion inhibitors, biocides, and combinations thereof.

One metalworking fluid concentrate of the disclosure includes:

- one or more water-soluble polymers (i.e., as otherwise described above), present in a total amount in the range of 25 wt % to 70 wt %;
- optionally, one or more of pressure-protective additives, corrosion inhibitors, rust inhibitors, lubricity enhancers, friction modifiers, chelating agents, coupling agents, yellow metal inhibitors, esters, biocides (e.g., as otherwise described above) present in the composition in an amount in the range up to 40 wt %; and
- water, present in an amount of at least 8 wt %,
- wherein the one or more water-soluble polymers, optional additives when present, and the water are dissolved in one another to form a single aqueous phase.

In certain embodiments, the one or more water soluble polymers is present in the metalworking fluid concentrate of the disclosure in an amount in the range of 30 wt % to 70 wt %, or 40 wt % to 70 wt %, or 15 wt % to 50 wt %, or 20 wt % to 50 wt %, or 25 wt % to 50 wt %, or 30 wt % to 50 wt %, based on the total weight of the composition.

The one or more water-soluble polymers can otherwise be as described above with respect to the metalworking compositions of the disclosure.

In order to aid with dispersal of the concentrate into aqueous media, the concentrate desirably includes at least 8 wt % water. In some embodiments, water is present in the additive in an amount of at least 10 wt %, at least 15 wt %, at least 20 wt %, at least 30 wt %, or even at least 40 wt %. In some embodiments, the metalworking fluid concentrate may include water in an amount the range of 8 wt % to 60 wt %, or 8 wt % to 50 wt %, or 8 wt % to 40 wt %, or 8 wt % to 30 wt %, or 8 wt % to 20 wt %, or 8 wt % to 15 wt %, or 10 wt % to 60 wt %, or 10 wt % to 50 wt %, or 10 wt % to 40 wt %, or 10 wt % to 30 wt %, or 10 wt % to 20 wt %, or 10 wt % to 15 wt %, or 15 wt % to 60 wt %, or 15 wt % to 50 wt %, or 15 wt % to 40 wt %, or 15 wt % to 30 wt %, or 20 wt % to 60 wt %, or 20 wt % to 50 wt %, or 20 wt % to 40 wt %.

While in some uses (e.g., as a top-treat additive) the concentrate requires no further additives, in certain desirable embodiments the metalworking fluid concentrates of the disclosure include one or more of pressure-protective additives, corrosion inhibitors, rust inhibitors, lubricity enhancers, friction modifiers, chelating agents, coupling agents, yellow metal inhibitors, esters, biocides, and combinations thereof present in the composition in an amount in the range up to 40 wt %. For example, in certain embodiments, the total amount of such one or more of pressure-protective additives, corrosion inhibitors, rust inhibitors, lubricity enhancers, friction modifiers, chelating agents, coupling agents, yellow metal inhibitors, esters, biocides, and combinations thereof is up to 30 wt %, up to 20 wt %, up to 10 wt %, or up to 5 wt %, or in the range of 0.1-40 wt %, or 0.1-30 wt %, or 0.1-20 wt %, or 0.1-10 wt %, or 0.1-5 wt %, or 0.5-40 wt %, or 0.5-30 wt %, or 0.5-20 wt %, or 0.5-10 wt %, or 0.1-5 wt %, or 1-40 wt %, or 1-30 wt %, or 1-20 wt %, or 1-10 wt %, or 1-5 wt %, or 5-40 wt %, or 5-30 wt %, or 5-20 wt %, or 5-10 wt %, or 10-40 wt %, or 10-30 wt %, or 10-20 wt %, or 20-40 wt %, or 20-30 wt %. In certain other embodiments the metalworking fluid concentrates of the disclosure include one or more of corrosion inhibitors, biocides, and combinations thereof present in the composition in an amount in the range up to 40 wt %. For example, in certain embodiments, the total amount of such one or more of corrosion inhibitors, biocides, and combinations thereof is up to 30 wt %, up to 20 wt %, up to 10 wt %, or up to 5 wt %, or in the range of 0.1-40 wt %, or 0.1-30 wt %, or 0.1-20 wt %, or 0.1-10 wt %, or 0.1-5 wt %, or 0.5-40 wt %, or 0.5-30 wt %, or 0.5-20 wt %, or 0.5-10 wt %, or 0.1-5 wt %, or 1-40 wt %, or 1-30 wt %, or 1-20 wt %, or 1-10 wt %, or 1-5 wt %, or 5-40 wt %, or 5-30 wt %, or 5-20 wt %, or 5-10 wt %, or 10-40 wt %, or 10-30 wt %, or 10-20 wt %, or 20-40 wt %, or 20-30 wt %. These additives can be as otherwise described above with respect to the metalworking fluid compositions of the disclosure.

The metalworking fluid compositions of the disclosure are particularly suitable for use in the cold working of metals, i.e., the working of metals below their recrystallization temperatures. Accordingly, another aspect of the disclosure is a method for cold working a metal, the method including contacting a surface of one or more working tools (e.g., rolls) with a metalworking fluid composition as described herein; and forming a surface of a metal article to a desired shape with the working tools in contact with the metalworking fluid composition.

The metalworking fluid compositions of the disclosure can be used at a variety of cold working compositions, depending, for example, on the particular concentrations and types of water-soluble polymers therein. In certain embodiments, the cold working methods otherwise described herein are performed at a temperature in the range of 0-95° C., e.g., in the range of 10-95° C., or 20-95° C., or 40-95° C., or 0-80° C., or 10-80° C., or 20-80° C., or 40-80° C., or 0-60° C., or 10-60° C., or 20-60° C., or 40-60° C.

One example of a type of cold working is cold rolling. In the cold rolling of metals, metal is deformed by rolling by one or more working rolls, e.g., by passing it between a pair of working rolls. A metalworking fluid of the disclosure can be applied to the interfaces between the metal to be rolled and one or more of the working rolls. Further, in a cold rolling mill, working rolls may be supported by support rolls, which prevent deformation of the working rolls. A metalworking fluid composition of the disclosure may also be applied to the contact between a surface of one or more work rolls and a surface of a support roll. A metalworking fluid composition of the disclosure may also be applied to the support bearings as the bearing lubricant in Zendsimir mills.

The metals on which such cold rolling may be carried out include ferrous metals, aluminium, copper, zinc, tin and copper-based alloys, such as bronze or brass. In certain preferred embodiments, the metalworking fluid composition of the disclosure is employed in the cold rolling of ferrous metals, such as steel.

Thus, in some embodiments, such methods include: contacting a surface of one or more working rolls with a metalworking fluid composition of the disclosure; and forming a surface of a metal article to a desired shape with the working rolls in contact with the metalworking fluid composition.

An advantage of single-phase water-based metalworking fluid compositions of the disclosure is that the composition may be washed away from the metalworking apparatus with water. The washed away or spent metalworking fluid composition may be recirculated to the apparatus. This recirculated composition can be further treated with the top-treat additive of the disclosure. Thus, in some embodiments, such methods include: obtaining a first portion of a metalworking fluid composition of the disclosure; contacting a surface of one or more working tools with the first portion of the metalworking fluid composition and forming a surface of a first metal article to a desired shape in contact with the first portion to generate a spent first portion; treating the spent first portion with a top-treat additive of the disclosure to generate a treated first portion; contacting the surface of one or more work rolls with the treated first portion; and forming a surface of a second metal article to a desired shape. The first metal article and the second metal article can be, for example, different zones of metal along a body thereof, such that the method can be used in a continuous rolling process of, e.g., metal sheet.

The present inventors have determined that the overall viscosity of the aqueous metalworking fluids described herein is an important determinant of performance. Thus, in certain embodiments of the methods as described herein, a measurement of the viscosity of a metalworking fluid composition is used to determine whether it needs treatment to regenerate its properties. Accordingly, in certain embodiments of the methods as described herein, the viscosity of a first portion of the metalworking fluid is measured. This can be done continuously or discontinuously, via any desirable method. The viscosity need not be measured as kinematic viscosity at 40° C.; any viscosity measurement suitable to understand a change in viscosity of the fluid can be used. Based on the measurement of the viscosity, the spent first portion can be treated with an amount of a metalworking fluid concentrate as described herein sufficient to provide a treated first portion with a kinematic viscosity at 40° C. in the range of 1 cSt and 20 cSt (or any other desirable viscosity value as otherwise described herein).

As described above, the concentrates of some embodiments of the disclosure can be diluted to provide metalworking fluid compositions of the disclosure. Accordingly, in one embodiment, a method for working a metal includes dissolving an amount of a composition of the disclosure in an aqueous fluid (e.g., water) to obtain a metalworking fluid composition of the disclosure, wherein the amount of the concentrate is sufficient to provide the metalworking fluid composition having a kinematic viscosity at 40° C. in the range of 1 cSt and 20 cSt; contacting a surface of one or more working tools with the metalworking fluid composition; and forming a surface of a metal article to a desired shape with the working tools in contact with the metalworking fluid composition.

Certain aspects of the disclosure are now explained further via the following non-limiting examples.

Example 1

Corrosion inhibitor, Syntilo 81BF (available from Castrol, Lewiston, N.Y.), and water were heated to 30° C., and pressure-protective additive P1 (olelyl ether phosphate ester) was then added and mixed until the mixture is clear and bright. The polymers having different kinematic viscosities at 40° C. were then added to the solution and mixed until the solution was clear. Table 1 provides the amounts of the polymer that were dissolved in water sufficient to provide the final metalworking composition having a desired viscosity.

FIG. 1 shows the relationship between the amount of the polymer in the composition and the kinematic viscosity at 40° C. of the composition. The compositions of Example 1, Comparative Example 1, and Comparative Example 2 were formulated at different polymer content (wt % based on the total weight of the composition) and their kinematic viscosities at 40° C. were measured in accordance with ASTM D4603.

TABLE 1

| Material | KV[1] (cSt) | Polymer (wt %) | Corrosion inhibitor (wt %) | P1 additive (wt %) | water (wt %) |
|---|---|---|---|---|---|
| Comp. ex. 1 | 2 | 15 | 5 | 0.5 | 79.5 |
| (BL77[2]) | 10 | 30 | 5 | 0.5 | 64.5 |
| | 20 | 39 | 5 | 0.5 | 55.5 |
| Comp. ex. 2[3] | 10 | 15 | 5 | 0.5 | 79.5 |
| Example 1 | 5 | 7 | 5 | 0.5 | 87.5 |
| (Breox 75W18000[4]) | 10 | 14 | 5 | 0.5 | 80.5 |

[1]kinematic viscosity at 40° C. of the final metalworking composition

[2]Lubricity additive S513 (BL77) (available from Castrol, Lewiston, NY) has kinematic viscosity of 202 cSt at 40° C.

[3]Non-commercial low viscosity EO-PO polymer has kinematic viscosity of 1350- 1200 cSt at 40° C.

[4]Breox 75W18000 (available from Cognis, Monheim am Rhein,Germany) has kinematic viscosity of 18000 cSt at 40° C.

The metalworking compositions were then tested for roll force and forward slip percent after four rolls. The results are provided in Table 2:

TABLE 2

| Material | KV (cSt) | Pass 1 roll force | Pass 1 forward slip % | Pass 2 roll force | Pass 2 forward slip % | Pass 3 roll force | Pass 3 forward slip % | Pass 4 roll force | Pass 4 forward slip % |
|---|---|---|---|---|---|---|---|---|---|
| Reference (neat oil) | 40 | 700-600 | 1.5-1.0 | 950 | 2.5-1.5 | 1200 | 5.0-4.0 | 1600-1400 | 12.0-6.0 |
| Comp. ex. 1 | 2 | 700-600 | 2.5-1.5 | 1000 | 5.0-4.5 | 1400 | 8.0-5.5 | Failed | Failed |
| (BL77) | 10 | 700-600 | 2.5-1.5 | 950 | 3.5 | 1400 | 5-4.5 | 1800-1400 | 12.0-6.1 |
| | 20 | 701-600 | 2.5-1.5 | 950 | 4.0-3.0 | 1400 | 5-4.6 | 1800-1400 | 12.0-6.2 |
| Comp. ex. 2 | 10 | 701-600 | 2.5-1.5 | 950 | 3.5 | 1300-1100 | 5.0-3.5 | 1600-1200 | 8.0-4.5 |
| Example 1 (Breox | 5 | 700 | 2.0-0.5 | 950-750 | 2.0-0.6 | 1100 | 5.0-2.0 | 1400-1100 | 7.0-5.0 |
| 75W18000) | 10 | 700 | 2.0-0.5 | 950-750 | 3.0-0.6 | 1100 | 5.0-2.0 | 1400-1100 | 8.0-5.0 |

The composition of Example 1 showed much improved forward slip than the comparative examples 1 and 2 or the reference composition. In addition, the composition of Example 1 showed a much flatter profile across the speed range up to and including 18 m/second, which is a top speed for the mill. Without being bound to a particular theory, the inventors believe that this result indicates stable and consistent metalworking fluid compositions, as well as improved friction due to reduced adhesive contact on the entry side of the mill. In addition, lower force is required in subsequent passes (i.e., less energy is used to deform material so lubricant is better contributing to the deformation), and using the metalworking fluid of the disclosure provides twofold benefits: to control (slip) and to deformation force.

Example 2

The metalworking fluid of Example 1 was further treated with a phosphorus additive. Two different additives were separately evaluated: P2 (PPG mono ester sold as Korantin® LUB, available from BASF) and P1 (olelyl ether phosphate ester).

Both phosphorus additive P2 and P1 had no effect on roll force or forward slip through trialling. But the chemistry of P2 offers advantage of preventing heat scratches on the strip at extremes of rolling temperature, and protects the strip up to temperatures of 160° C.

It is understood that the examples and embodiments described herein are for illustrative purposes only and that various modifications or changes in light thereof will be suggested to persons skilled in the art and are to be incorporated within the spirit and purview of this application and scope of the appended claims. All publications, patents, and patent applications cited herein are hereby incorporated herein by reference for all purposes.

Various aspects of the present disclosure are further exemplified by the non-limiting embodiments recited in the enumerated embodiments below. In each case, features of multiple enumerated embodiments can be combined in any fashion not inconsistent with the specification and not logically inconsistent.

Embodiment 1. An aqueous metalworking fluid composition comprising:

one or more water-soluble polymers, each having a kinematic viscosity at 40° C. of at least 5000 cSt and no cloud point within a temperature range of 20° C. to 80° C., present in a total amount in the range of 0.5 wt % to 15 wt %; and water, present in an amount of at least 70 wt %, wherein the composition has a kinematic viscosity at 40° C. in the range of 1 cSt to 20 cSt, and wherein the one or more water-soluble polymers are dissolved in an aqueous phase of the aqueous metalworking fluid.

Embodiment 2. The composition of embodiment 1, wherein the composition is a substantially single-phase composition.

Embodiment 3. The composition of embodiment 2, wherein the composition comprising at least 98 wt % of the aqueous phase, e.g., at least 99 wt %, at least 99.5 wt %, or at least 99.8% of the aqueous phase.

Embodiment 4. The composition of any of embodiments 1-3, having a kinematic viscosity at 40° C. in the range of 2 cSt to 20 cSt, or 5 cSt to 20 cSt, or 10 cSt to 20 cSt, or 1 cSt to 15 cSt, or 2 cSt to 15 cSt, or 5 cSt to 15 cSt, or 10 cSt to 15 cSt, or 1 cSt to 10 cSt, or 2 cSt to 10 cSt, or 5 cSt to 10 cSt, or 10 cSt to 15 cSt, or 10 cSt to 20 cSt, or 5 cSt to 15 cSt, or 3 cSt to 7 cSt, or 4 cSt to 6 cSt, or 4.5 cSt to 5.5 cSt.

Embodiment 5. The composition of any of embodiments 1-4, wherein each of the water-soluble polymers has a kinematic viscosity at 40° C. in the range of 5000 cSt to 100000 cSt, or 5000 cSt to 75000 cSt, or 5000 cSt to 50000 cSt, or 5000 cSt to 30000 cSt, or 5000 cSt to 25000 cSt, or 5000 cSt to 20000 cSt.

Embodiment 6. The composition of any of embodiments 1-4, wherein each of the one or more water-soluble polymers has a kinematic viscosity at 40° C. of at least 7500 cSt, e.g., at least 10000 cSt, at least 15000 cSt, or at least 17000 cSt.

Embodiment 7. The composition of any of embodiments 1-4, wherein each of the one or more water-soluble polymers has a kinematic viscosity at 40° C. in the range of 7500 cSt to 100000 cSt, or 7500 cSt to 75000 cSt, or 7500 cSt to 50000 cSt, or 7500 cSt to 30000 cSt, or 10000 cSt to 100000 cSt, or 10000 cSt to 75000 cSt, or 10000 cSt to 50000 cSt, or 10000 cSt to 30000 cSt, or 10000 cSt to 25000 cSt, or 10000 cSt to 20000 cSt, or 10000 cSt to 19000 cSt, or 10000 cSt to 18000 cSt.

Embodiment 8. The composition of any of embodiments 1-4, wherein each of the one or more water-soluble polymers has a kinematic viscosity at 40° C. in the range of 15000 cSt to 100000 cSt, or 15000 cSt to 75000 cSt, or 15000 cSt to 50000 cSt, or 15000 cSt to 30000 cSt, or 15000 cSt to 25000 cSt, or 15000 cSt to 20000 cSt, or 15000 cSt to 19000 cSt, or 17000 cSt to 100000 cSt, or 17000 cSt to 75000 cSt, or 17000 cSt to 50000 cSt, or 17000 cSt to 30000 cSt, or 17000 cSt to 25000 cSt or 17000 cSt to 20000 cSt, or 17000 cSt to 19000 cSt.

Embodiment 9. The composition of any of embodiments 1-8, wherein each of the one or more water-soluble polymers has a viscosity index of at least 80, e.g., at least 120, or at least 200, or even at least 300.

Embodiment 10. The composition of any of embodiments 1-8, wherein each of the one or more water-soluble polymers has a viscosity index in the range of 80-800, or 80-650, or 80-500, or 120-800, or 120-650, or 200-800, or 200-650, or 200-500, or 300-800, or 300-650, or 300-500.

Embodiment 11. The composition of any of embodiments 1-10, wherein each of the water-soluble polymers has a kinematic viscosity at 100° C. of no more than 20000 cSt, e.g., no more than 15000 cSt or no more than 10000 cSt.

Embodiment 12. The composition of any of embodiments 1-10, wherein each of the water-soluble polymers has a kinematic viscosity at 100° C. in the range of 500-20000 cSt, or 500-15000 cSt, or 500-10000 cSt, or 500-5000 cSt, or 1000-20000 cSt, or 1000-15000 cSt, or 1000-10000 cSt, or 1000-5000 cSt, of 2000-5000 cSt.

Embodiment 13. The composition of any of embodiments 1-12, wherein each of the one or more water-soluble polymers has no cloud point within a temperature range of 10° C. to 80° C., or 0° C. to 80° C., or 20° C. to 100° C., or 10° C. to 100° C., or 0° C. to 100° C., or 20° C. to 120° C., or 10° C. to 120° C., or 0° C. to 120° C.

Embodiment 14. The composition of any of embodiments 1-13, wherein each of the one or more water-soluble polymers is a polyalkylene glycol polymer, e.g., a polymer of one or more of ethylene oxide, propylene oxide and butylene oxide.

Embodiment 15. The composition of embodiment 14, wherein each of the one or more water-soluble polymers is a copolymer of two or more of ethylene oxide, propylene oxide, and butylene oxide.

Embodiment 16. The composition of embodiment 14, wherein each of the one or more water-soluble polymers is a copolymer of ethylene oxide and propylene oxide.

Embodiment 17. The composition of embodiment 12, wherein each of the one or more water-soluble polymers is a diol-initiated random copolymer of ethylene oxide and propylene oxide.

Embodiment 18. The composition of embodiment 16 or embodiment 17, wherein in each of the one or more water-soluble polymers the ratio of ethylene oxide and propylene oxide is in the range of 25:75 to 75:25 by weight.

Embodiment 19. The composition of any of embodiments 15-18, wherein ethylene oxide, propylene oxide and/or butylene oxide subunits make up at least 95%, e.g., at least 98% or even at least 99% of the mass of each of the one or more water-soluble polymers.

Embodiment 20. The composition of any of embodiments 15-19, wherein each of the one or more water-soluble polymers is a random copolymer.

Embodiment 21. The composition of any of embodiments 1-20, wherein the one or more water-soluble polymers are present in the composition in a total amount of 0.5 wt % to 10 wt %, or 0.5 wt % to 5 wt %, or 0.5 to 4 wt %, or 0.5 wt % to 3 wt %, or 0.5 wt % to 2 wt %, or 0.5 wt % to 1.5 wt %, or 1 wt % to 15 wt %, or 1 wt % to 10 wt %, or 1 wt % to 5 wt %, or 1 to 4 wt %, or 1 wt % to 3 wt %, based on the total weight of the composition.

Embodiment 22. The composition of any of embodiments 1-21, wherein each of the one or more water-soluble polymers has a $M_W$ of 800 Da to 100 kDa, e.g., in the range of 2-100 kDa, or 5-100 kDa, or 10-100 kDa, or 2-50 kDa, or 5-50 kDa, or 10-50 kDa.

Embodiment 23. The composition of any of embodiments 1-22, wherein water is present in the composition in an amount of at least 75%, or at least 80%, or at least 85%, or at least 90%.

Embodiment 24. The composition of any of embodiments 1-22, wherein water is present in the composition in an amount in the range of 70 wt % to 99.5 wt %, e.g., 75 wt % to 99.5 wt %, or 80 wt % to 99.5 wt %, or 85 wt % to 99.5 wt %, or 90 wt % to 99.5 wt %, or 95 wt % to 99.5 wt %, or 97 wt % to 99.5 wt %, or 75 wt % to 99 wt %, or 80 wt % to 99 wt %, or 85 wt % to 99 wt %, or 90 wt % to 99 wt %, or 95 wt % to 99 wt %, or 97 wt % to 99 wt %, or 70 wt % to 97 wt %, or 75 wt % to 97 wt %, or 80 wt % to 97 wt %, or 85 wt % to 97 wt %, or 90 wt % to 97 wt %, or 95 wt % to 97 wt %, or 70 wt % to 95 wt %, or 75 wt % to 95 wt %, or 80 wt % to 95 wt %, or 85 wt % to 95 wt %, or 90 wt % to 95 wt %.

Embodiment 25. The composition of any of embodiments 1-24, further comprising one or more of pressure-protective additives, corrosion inhibitors, rust inhibitors, lubricity enhancers, friction modifiers, chelating agents, coupling agents, yellow metal inhibitors, esters, biocides, and combinations thereof present in the composition in an amount up to 15 wt %, e.g., up to 10 wt %, up to 8 wt % or up to 5 wt %, based on the total weight of the composition.

Embodiment 26. The composition according to embodiment 24, wherein the one or more of pressure-protective additives, corrosion inhibitors, rust inhibitors, lubricity enhancers, friction modifiers, chelating agents, coupling agents, yellow metal inhibitors, esters and biocides are present in the composition in an amount in the range of 0.1-15 wt %, or 0.1-10 wt %, or 0.1-8 wt %, or 0.1-5 wt %, or 0.5-15 wt %, or 0.5-10 wt %, or 0.5-8 wt %, or 0.5-5 wt %, or 1-15 wt %, or 1-10 wt %, or 1-8 wt %, or 1-5 wt %, or 2-15 wt %, or 2-10 wt %, or 2-8 wt %, or 2-5 wt %, or 5-15 wt % or 5-10 wt %, based on the total weight of the composition).

Embodiment 27. The composition of embodiment 25 or embodiment 26, comprising the one or more pressure-protective additives (e.g., present in a total amount up to 15 wt %, for example, up to 10 wt %, up to 8 wt % or up to 5 wt %).

Embodiment 28. The composition of embodiment 27, wherein the one or more pressure-protective additives is selected from a phosphate ester, dithiophosphate, amine phosphate, phosphorothionate, alkyl phosphate, aryl phosphate, carboxylic acid, and any combination thereof.

Embodiment 29. The composition of any of embodiments 26-28 further comprising the one or more of corrosion inhibitors, rust inhibitors, lubricity enhancers, friction modifiers, chelating agents, coupling agents, yellow metal inhibitors, esters, biocides, and combinations thereof (e.g., present in a total amount up to 15 wt %, for example, up to 10 wt %, up to 8 wt % or up to 5 wt %).

Embodiment 30. The composition of any of embodiments 1-29, comprising the one or more water-soluble polymers;

a corrosion-inhibiting combination comprising one or more carboxylic acids in an amount in the range of 0.1 wt % to 1 wt % and one or more amines in an amount in the range of 0.1 wt % to 2 wt %;

one or more yellow metal inhibitors (e.g., triazole) in an amount in the range of 0.01 wt % to 0.2 wt %;

optionally one or more pressure-protective additives (e.g., phosphate ester) in an amount of up to 0.25 wt %; and optionally, a biocide in an amount in the range of 0.05 wt % to 0.25 wt %.

Embodiment 31. The composition of any of embodiments 1-30, wherein the total amount of water and the one or more water-soluble polymers is at least 75 wt % of the total weight of the composition, e.g., at least 85 wt %, at least 90 wt % or even at least 95 wt % of the total weight of the composition.

Embodiment 32. The composition of any of embodiments 1-30, wherein the total amount of water, the one or more water-soluble polymers, and any pressure-protective additives, corrosion inhibitors, rust inhibitors, lubricity enhancers, friction modifiers, chelating agents, coupling agents, yellow metal inhibitors, esters and biocides is at least 75 wt % of the composition, e.g., at least 80 wt %, at least 85 wt %, at least 90 wt %, at least 95 wt %, at least 98 wt % or even at least 99 wt % of the composition.

Embodiment 33. The composition of any of embodiments 1-34, substantially free of mineral oil and silicone oil.

Embodiment 34. A metalworking fluid concentrate comprising:

one or more water-soluble polymers, each having a kinematic viscosity at 40° C. of at least 5000 cSt and no cloud point within a temperature range of 20° C. to 80° C., present in an amount in the range of 25 wt % to 70 wt %;

optionally, one or more of pressure-protective additives, corrosion inhibitors, rust inhibitors, lubricity enhancers, friction modifiers, chelating agents, coupling agents, yellow metal inhibitors, esters and biocides, present in the composition in a total amount up to 40 wt %; and water, present in an amount of at least 8 wt %, wherein the one or more water-soluble polymers, optional additives when present, and the water are dissolved in one another to form a single aqueous phase.

Embodiment 35. The concentrate of embodiment 34, wherein the one or more water soluble polymers is present in an amount of 30 wt % to 70 wt %, or 40 wt % to 70 wt %, or 15 wt % to 50 wt %, or 20 wt % to 50 wt %, or 25 wt % to 50 wt %, or 30 wt % to 50 wt %, based on the total weight of the concentrate.

Embodiment 36. The concentrate of embodiment 34 or embodiment 35, wherein water is present in the concentrate in the range of 8 wt % to 50 wt %, or 8 wt % to 40 wt %, or 8 wt % to 30 wt %, or 8 wt % to 20 wt %, or 8 wt % to 15 wt %, or 10 wt % to 50 wt %, or 10 wt % to 40 wt %, or 10 wt % to 30 wt %, or 10 wt % to 20 wt %, or 10 wt % to 15 wt %, or 15 wt % to 50 wt %, or 15 wt % to 40 wt %, or 15 wt % to 30 wt %, or 20 wt % to 60 wt %, or 20 wt % to 50 wt %, or 20 wt % to 40 wt %.

Embodiment 37. The concentrate of embodiment 34 or embodiment 35, wherein water is present in the concentrate in an amount of at least 10 wt %, at least 15 wt %, at least 20 wt %, at least 30 wt %, or even at least 40 wt % of the concentrate.

Embodiment 38. The concentrate of any of embodiments 34-37, wherein the one or more water-soluble polymers is further as described in any of embodiments 5-20.

Embodiment 39. The concentrate of any of embodiments 34-38, comprising one or more of pressure-protective additives, corrosion inhibitors, rust inhibitors, lubricity enhancers, friction modifiers, chelating agents, coupling agents, yellow metal inhibitors, biocides, and combinations thereof present in the composition in a total amount up to 40 wt %, e.g., up to 30 wt %, up to 20 wt %, up to 10 wt %, or up to 5 wt %.

Embodiment 40. The concentrate of any of embodiments 34-38, comprising one or more of pressure-protective additives, corrosion inhibitors, rust inhibitors, lubricity enhancers, friction modifiers, chelating agents, coupling agents, yellow metal inhibitors, biocides, and combinations thereof present in the composition in a total amount in the range of 0.1-40 wt %, or 0.1-30 wt %, or 0.1-20 wt %, or 0.1-10 wt %, or 0.1-5 wt %, or 0.5-40 wt %, or 0.5-30 wt %, or 0.5-20 wt %, or 0.5-10 wt %, or 0.1-5 wt %, or 1-40 wt %, or 1-30 wt %, or 1-20 wt %, or 1-10 wt %, or 1-5 wt %, or 5-40 wt %, or 5-30 wt %, or 5-20 wt %, or 5-10 wt %, or 10-40 wt %, or 10-30 wt %, or 10-20 wt %, or 20-40 wt %, or 20-30 wt %.

Embodiment 41. A method of cold working a metal, the method comprising contacting a surface of one or more working tools with a metalworking fluid composition of any of embodiments 1-33; and forming a surface of a metal article to a desired shape with the one or more working tools in contact with the metalworking fluid composition.

Embodiment 42. The method of embodiment 41, wherein the forming is carried out at a temperature in the range of 0-95° C., e.g., in the range of 10-95° C., or 20-95° C., or 40-95° C., or 0-80° C., or 10-80° C., or 20-80° C., or 40-80° C., or 0-60° C., or 10-60° C., or 20-60° C., or 40-60° C.

Embodiment 43. The method of embodiment 41 or embodiment 42, wherein the cold working is a cold rolling, and wherein the one or more working tools is one or more working rolls.

Embodiment 44. A method of cold working a metal, the method comprising obtaining a first portion of a metalworking fluid composition of any of embodiments 1-33;

contacting a surface of one or more working tools with the first portion of the metalworking fluid composition and forming a surface of a first metal article to a desired shape in contact with the first portion to generate a spent first portion;

treating the spent first portion with a concentrate of any embodiments 34-40;

contacting the surface of one or more working tools with the treated first portion; and forming a surface of a second metal article to a desired shape in contact with the treated first portion.

Embodiment 45. The method of embodiment 44, the method further comprising measuring a viscosity of the spent first portion; and wherein based on the measured viscosity of the spent first portion, the treating of the spent first portion is with an amount of the concentrate sufficient to provide the treated first portion with a kinematic viscosity at 40° C. in the range of 1 cSt and 20 cSt.

Embodiment 46. A method of cold working a metal, the method comprising dissolving an amount of a concentrate according to any embodiments 34-40 in an aqueous fluid (e.g., water) to obtain a metalworking fluid composition of any of embodiments 1-33, wherein the amount of the top-treat additive is sufficient to provide the metalworking fluid composition having a kinematic viscosity at 40° C. in the range of 1 cSt to 20 cSt;

contacting a surface of one or more working tools with the metalworking fluid composition; and forming a surface of a metal article to a desired shape with the working tools in contact with the metal working fluid composition.

I claim:

1. An aqueous metalworking fluid composition comprising:

one or more water-soluble polymers, each having a kinematic viscosity at 40° C. of at least 5000 cSt and no cloud point within a temperature range of 20° C. to 100° C., present in a total amount in the range of 0.5 wt % to 15 wt %;

one or more of pressure-protective additives, corrosion inhibitors, rust inhibitors, lubricity enhancers, friction modifiers, chelating agents, coupling agents, yellow metal inhibitors, esters, biocides, and combinations thereof; and water, present in an amount of at least 70 wt %, wherein the composition has a kinematic viscosity at 40° C. in the range of 2 cSt to 10 cSt, and wherein the one or more water-soluble polymers are dissolved in an aqueous phase of the aqueous metalworking fluid.

2. The composition of claim 1, wherein the composition is a substantially single-phase composition.

3. The composition of claim 1, having a kinematic viscosity at 40° C. in the range of 3 cSt to 7 cSt.

4. The composition of claim 1, wherein each of the one or more water-soluble polymers has a kinematic viscosity at 40° C. in the range of 10000 cSt to 25000 cSt.

5. The composition of claim 1, wherein each of the one or more water-soluble polymers has a viscosity index in the range of 200-800.

6. The composition of claim 1, wherein each of the water-soluble polymers has a kinematic viscosity at 100° C. of no more than 20000 cSt.

7. The composition of claim 1, wherein each of the water-soluble polymers has a kinematic viscosity at 100° C. in the range of 1000-10000 cSt.

8. The composition of claim 1, wherein each of the one or more water-soluble polymers has no cloud point within a temperature range of 20° C. to 100° C.

9. The composition of claim 1, wherein each of the one or more water-soluble polymers is a copolymer of two or more of ethylene oxide, propylene oxide, and butylene oxide wherein ethylene oxide, propylene oxide and/or butylene oxide subunits make up at least 95% of the mass of each of the one or more water-soluble polymers.

10. The composition of claim 9, wherein each of the one or more water-soluble polymers is a copolymer of ethylene oxide and propylene oxide, wherein in each of the one or more water-soluble polymers the ratio of ethylene oxide and propylene oxide is in the range of 25:75 to 75:25 by weight.

11. The composition of claim 9, wherein each of the one or more water-soluble polymers is a random copolymer.

12. The composition of claim 1, wherein the one or more water-soluble polymers are present in the composition in a total amount of 0.5 wt % to 5 wt %, based on the total weight of the composition.

13. The composition of claim 1, wherein each of the one or more water-soluble polymers has a $M_w$ of 800 Da to 100 kDa.

14. The composition of claim 1, wherein water is present in the composition in an amount of at least 85%.

15. The composition of claim 1, comprising the one or more water-soluble polymers;

a corrosion-inhibiting combination comprising one or more carboxylic acids in an amount in the range of 0.1 wt % to 1 wt % and one or more amines in an amount in the range of 0.1 wt % to 2 wt %;

one or more yellow metal inhibitors in an amount in the range of 0.01 wt % to 0.2 wt %;

optionally one or more pressure-protective additives in an amount of up to 0.25 wt %; and optionally, a biocide in an amount in the range of 0.05 wt % to 0.25 wt %.

16. The composition of claim 1, substantially free of mineral oil and silicone oil.

17. A method of cold working a metal, the method comprising contacting a surface of one or more working tools with a metalworking fluid composition of claim 1; and forming a surface of a metal article to a desired shape with the one or more working tools in contact with the metalworking fluid composition.

18. A metalworking fluid concentrate comprising:

one or more water-soluble polymers, each having a kinematic viscosity at 40° C. of at least 5000 cSt and no cloud point within a temperature range of 20° C. to 80° C., present in an amount in the range of 25 wt % to 70 wt %;

optionally, one or more of pressure-protective additives, corrosion inhibitors, rust inhibitors, lubricity enhancers, friction modifiers, chelating agents, coupling agents, yellow metal inhibitors, esters and biocides, present in the composition in a total amount up to 40 wt %; and water, present in an amount of at least 8 wt %, wherein the one or more water-soluble polymers, optional additives when present, and the water are dissolved in one another to form a single aqueous phase.

19. A method of cold working a metal, the method comprising obtaining a first portion of a metalworking fluid composition, wherein the metalworking fluid composition comprises:

one or more water-soluble polymers, each having a kinematic viscosity at 40° C. of at least 5000 cSt and no cloud point within a temperature range of 20° C. to 80° C., present in a total amount in the range of 0.5 wt % to 15 wt %; and water, present in an amount of at least 70 wt %, wherein the composition has a kinematic viscosity at 40° C. in the range of 1 cSt to 20 cSt, and wherein the one or more water-soluble polymers are dissolved in an aqueous phase of the aqueous metalworking fluid;

contacting a surface of one or more working tools with the first portion of the metalworking fluid composition and forming a surface of a first metal article to a desired shape in contact with the first portion to generate a spent first portion;

treating the spent first portion with a concentrate of claim 18;

contacting the surface of one or more working tools with the treated first portion; and forming a surface of a second metal article to a desired shape in contact with the treated first portion.

20. A method of cold working a metal, the method comprising dissolving an amount of a concentrate according to claim 19 in an aqueous fluid to obtain a metalworking fluid composition, wherein the amount of the concentrate is sufficient to provide the metalworking fluid composition having a kinematic viscosity at 40° C. in the range of 1 cSt to 20 cSt;

contacting a surface of one or more working tools with the metalworking fluid composition; and forming a surface of a metal article to a desired shape with the working tools in contact with the metal working fluid composition.

* * * * *